US005905222A

United States Patent [19]

Yamada

[11] Patent Number: 5,905,222

[45] Date of Patent: May 18, 1999

[54] SILENT STRINGED INSTRUMENT FOR PRODUCING ELECTRIC SOUND FROM VIRTUAL SOUND SOURCE SAME AS THAT OF ACOUSTIC STRINGED INSTRUMENT

[75] Inventor: Toshiya Yamada, Shizuoka, Japan

[73] Assignee: Yamaha Corporation, Japan

[21] Appl. No.: 08/958,330

[22] Filed: Oct. 28, 1997

[30] Foreign Application Priority Data

Oct. 29, 1996 [JP] Japan ..... 8-286965

[51] Int. Cl.[6] ..... G10H 1/047

[52] U.S. Cl. ..... 84/630; 84/626; 84/662; 84/737

[58] Field of Search ..... 84/723–728, 730–731, 84/737, 741, DIG. 24, 170–171, 626–627, 630, 633, 662–663, 665

[56] References Cited

U.S. PATENT DOCUMENTS 5,025,703 6/1991 Iba et al. .
5,386,082 1/1995 Higashi ..... 84/630
5,444,180 8/1995 Shioda et al. .
5,763,803 6/1998 Hoshiai et al. ..... 84/626
5,818,944 10/1998 Takamiya et al. ..... 381/63

FOREIGN PATENT DOCUMENTS 0568789 3/1993 European Pat. Off. .

*Primary Examiner*—William M. Shoop, Jr.
*Assistant Examiner*—Marlon T. Fletcher
*Attorney, Agent, or Firm*—Ostrolenk, Faber, Gerb & Soffen, LLP

[57] ABSTRACT

A silent violin converts vibrations of strings to an electric signal, and the electric signal is supplied to two delay circuits and, thereafter, two multipliers so as to produce a left sound signal and a right sound signal different in delay time and magnitude; when a headphone produces stereophonic sounds from the left/right sound signals, the player feels the source of stereophonic sounds to be at a certain point on the silent violin same as an acoustic violin.

8 Claims, 5 Drawing Sheets

SILENT STRINGED INSTRUMENT FOR PRODUCING ELECTRIC SOUND FROM VIRTUAL SOUND SOURCE SAME AS THAT OF ACOUSTIC STRINGED INSTRUMENT

FIELD OF THE INVENTION

This invention relates to an electric stringed instrument and, more particularly, to an electric stringed musical instrument with an image locator for producing an image of sound source.

DESCRIPTION OF THE RELATED ART

A typical example of the electric stringed musical instrument is an electric guitar. A neck projects from a solid body, and strings are stretched over the solid body. Electromagnetic pickups are provided under the strings, and the electromagnetic pickup converts the vibrations of the associated string to an electric signal. The electric signal is supplied to a filter/amplifier circuit, and a speaker produces an electric guitar sound from the electric signal.

On the other hand, an acoustic guitar has a sound chamber under the strings, and the sound chamber resonates with the vibrations of the strings. For this reason, the acoustic guitar sounds are radiated from the sound chamber, and give unique impression different from the electric guitar sounds to listener. The electric guitar sound is rather simple than the acoustic guitar sound, and various effects are imparted thereto through a signal processing. The electric guitar sound is produced from the speaker, and the loudness is controllable by manipulating the amplifier. However, it is impossible to change the loudness of the acoustic guitar sound.

Similarly, bowed stringed musical instrument such as a violin produces an acoustic violin sound through resonance of the sound chamber with the vibrations of each string, and the acoustic violin sound is loud. Thus, the acoustic bowed stringed musical instrument produces loud sounds, and disturbs the neighbor. For this reason, a silent bowed stringed musical instrument has been developed. The silent bowed stringed musical instrument has a pickup or a vibration-to-electric signal converter, and the pickup produces an electric signal from the vibrations of the strings as similar to the electric guitar. If a player hears the electric sounds from a headphone, he can repeat the practice without disturbance to the neighbor.

However, the prior art electric bowed stringed musical instrument encounters a problem in that the player feels a sound source stationary. This is because of the fact that monaural sound is produced from the vibrations of the strings. The player feels the image strange, and is liable to be exhausted during long practice.

SUMMARY OF THE INVENTION

It is therefore an important object of the present invention to provide a silent bowed stringed musical instrument which causes a player to image a sound source equivalent to that of an acoustic bowed stringed musical instrument.

To accomplish the object, the present invention proposes to introduce two kinds of time delay different from each other into signal propagation of an electric signal produced from vibrations of a string.

In accordance with one aspect of the present invention, there is provided a silent stringed musical instrument comprising a body structure held by a player in an offset manner from a virtual center plane perpendicular to a virtual line between a first sound producing means and a second sound producing means, at least one string stretched over the body structure and caused to vibrate by the player, and an electric system for converting the vibrations of the at least one string to sounds, and the electric system includes a vibration-to-electric signal converter producing an electric signal from the vibrations, a delay circuit introducing a first delay time and a second delay time into propagation of the electric signal by 0.5 millisecond to 1.0 millisecond and 1.0 millisecond to 2.0 milliseconds for producing a first delayed signal and a second delayed signal, and a level changing circuit regulating a ratio of the magnitude of the second delayed signal to the magnitude of the first delayed signal to 2.0 to 4.0 for locating a sound source of the sounds around a sound source of acoustic sounds produced from an acoustic stringed musical instrument.

In accordance with another aspect of the present invention, there is provided a silent stringed musical instrument comprising a body structure held by a player in an offset manner from a virtual center plane perpendicular to a virtual line between a first sound producing means and a second sound producing means, at least one string stretched over the body structure and caused to vibrate by the player and an electric system for converting the vibrations of the at least one string to sounds, and the electric system includes a vibration-to-electric signal converter producing an electric signal from the vibrations, a memory means for storing an impulse response characteristics of a propagation from a sound source of acoustic sounds in an acoustic stringed instrument to a first sound producing means and a second sound producing means and an output means imparting the impulse response characteristics to the electric signal for locating a sound source of the silent stringed musical instrument around the sound source of the acoustic sounds with respect to the first and second sound producing means.

BRIEF DESCRIPTION OF THE DRAWINGS

The features and advantages of the silent bowed stringed musical instrument will be more clearly understood from the following description taken in conjunction with the accompanying drawings in which.

DESCRIPTION OF THE PREFERRED EMBODIMENTS

First Embodiment

Figure 1:
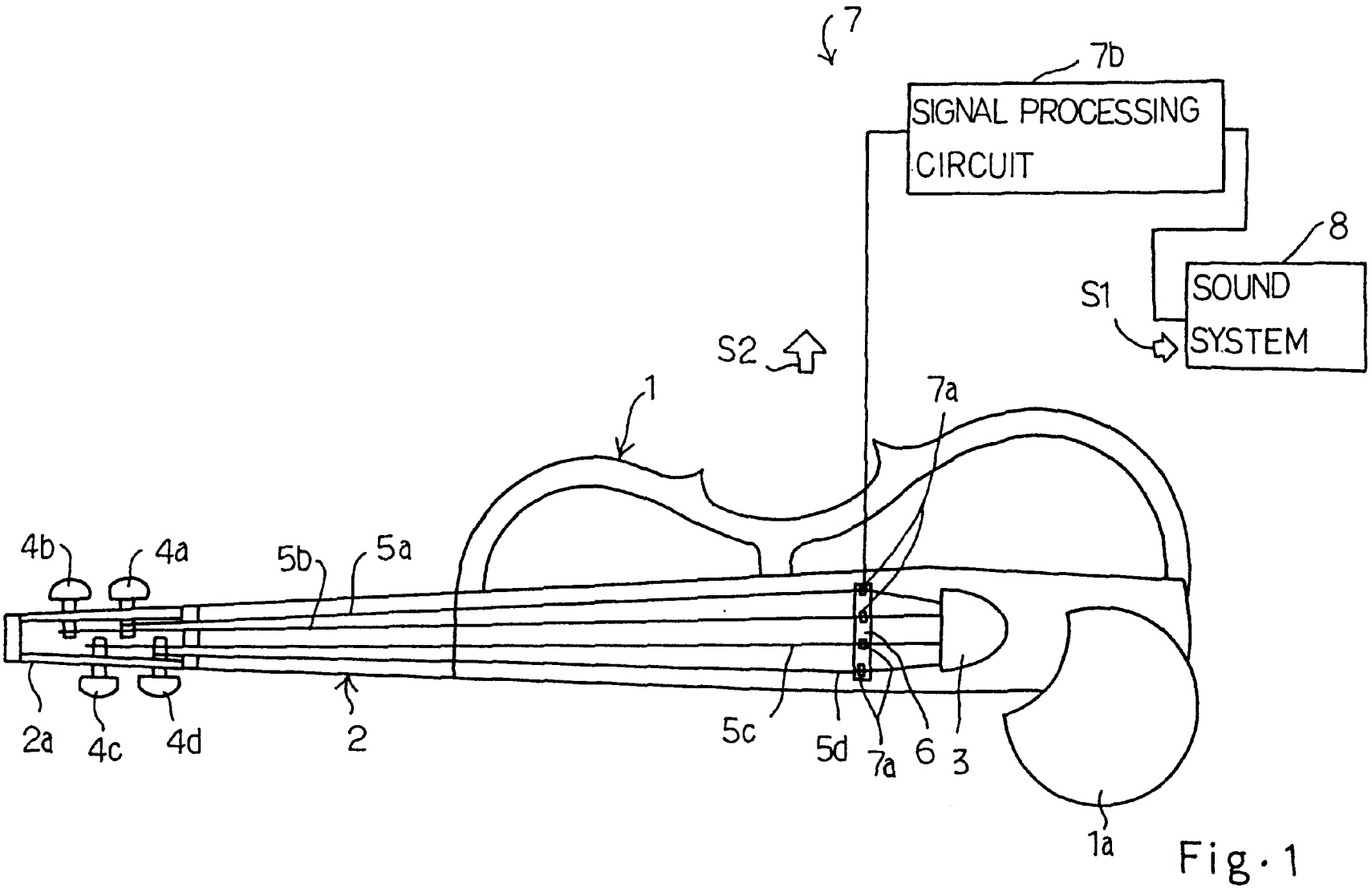
FIG. 1 is a plan view showing the structure of a silent violin according to the present invention.

Referring to FIG. 1 of the drawings, a silent violin embodying the present invention comprises a body 1, a neck 2 projecting from the body 1 and a tail piece 3 attached to the body 1. The body 1 is solid, and no resonant chamber is formed in the body. The body 1 may be formed of wooden pieces or synthetic resin pieces. The body 1 has a configuration like a half of the sound chamber of an acoustic violin, and the other half of the sound chamber is replaced with a pad 1*a*. While a violinist is playing a tune, he puts his chin on the pad 1*a,* and bows the silent violin. The neck 2 has a peg box 2*a,* and the peg box 2*a* defines an inner space.

The silent violin further comprises four peg screws 4*a,* 4*b,* 4*c* and 4*d* and four strings 5*a,* 5*b,* 5*c* and 5*d.* The peg screws 4*a* to 4*d* are screwed into the peg box 2*a,* and project the leading end portions thereof into the inner space. The four strings 5*a* to 5*d* are respectively wound on the peg screws 4*a* to 4*d,* and are anchored at the other ends thereof to the tail piece 3. Thus, the strings 5*a* to 5*d* are stretched between the peg screws 4*a* to 4*d* and the tail-piece 3.

The silent violin further comprises a bridge 6 attached to the body 1 under the strings 5*a* to 5*d,* an electric system 7 for producing an audio signal S1 from the vibrations of each string 5*a*/5*b*/5*c*/5*d* and a sound system 8 for producing stereophonic sounds from the audio signal S1. The electric system 7 includes a pickup 7*a* held in contact with the bridge 6 and a signal processing circuit 7*b*. The pickup 7*a* converts the vibrations of the strings 5*a* to 5*d* to an analog signal S2. The analog signal S2 is supplied from the pickup 7*a* to the signal processing circuit 7*b,* and the signal processing circuit 7*b* produces stereophonic signals SL1 and SR1 as follows.

Figure 2:
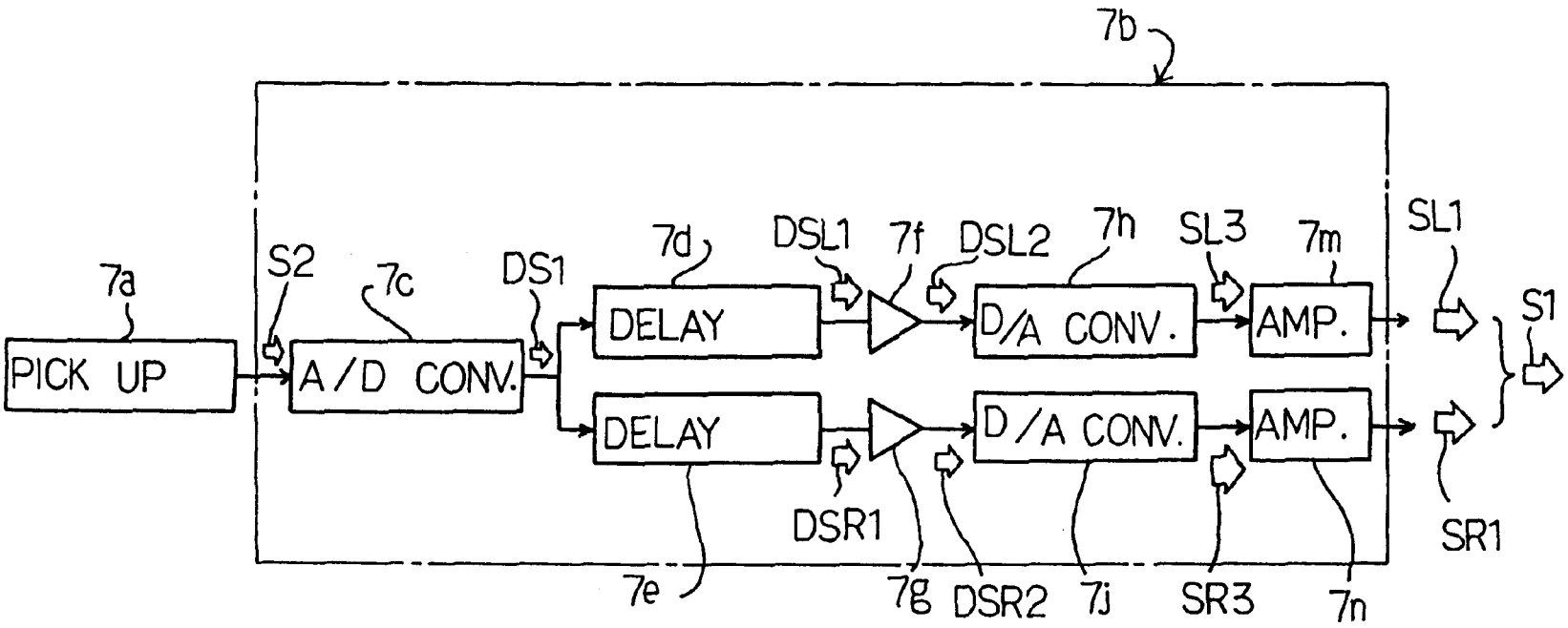
FIG. 2 is a block diagram showing the circuit arrangement of a signal processing circuit incorporated in the silent violin.

FIG. 2 illustrates the circuit configuration of the signal processing circuit 7*b*. The signal processing circuit 7*b* includes an analog-to-digital converter 7*c* connected to the pickup 7*a,* two delay circuits 7*d*/7*e* connected in parallel to the analog-to-digital converter 7*c,* two multipliers 7*f*/7*g* respectively connected to the delay circuits 7*d*/7*e,* two digital-to-analog converters 7*h*/7*j* connected to the multipliers 7*f*/7*g,* respectively, and two amplifiers 7*m*/7*n* respectively connected to the digital-to-analog converters 7*h*/7*j*.

The analog-to-digital converter 7*c* periodically samples the analog signal S2, and converts sampled values to a series of digital codes DS1. The digital codes DS1 are sequentially supplied to both delay circuits 7*d*/7*e,* and the delay circuits 7*d*/7*e* introduce time delays into the propagation of the digital codes DS1. The delay circuit 7*d* delays the digital codes DS1 by ΔtL, and the other delay circuit 7*e* introduce time delay ΔtR into the propagation of the digital codes DS1. For this reason, the delay circuits 7*d*/7*e* supply digital signals DSL1 and DSR1 to the multipliers 7*f*/7*g,* respectively.

The multipliers 7*f*/7*g* multiply the values of the digital signals DSL1 and DSR1 by predetermined coefficient M1 and M2, and digital product signals DSL2/DSR2 are supplied to digital-to-analog converters 7*h*/7*j,* respectively. The digital-to-analog converters 7*h*/7*j* convert the digital product signals DSL2/DSR2 to analog product signals SL3/SR3, and supply the analog product signals SL3/SR3 to the amplifiers 7*m*/7*n,* respectively. The amplifiers 7*m*/7*n* amplify the analog product signals SL3/SR3, respectively, and supply the stereophonic signals SL1/SR1 to the sound system 8. The sound system 8 contains a headphone (not shown), and a player can hear the stereophonic sound from the headphone.

In this instance, the body 1, the neck 2, the peg box 2*a,* the peg screws 4*a* to 4*d,* the tail piece 3, the pad 1*a* and the bridge 6 as a whole constitute a body structure. The pickup 7*a* and the analog-to-digital converter 7*c* form in combination a vibration-to-electric signal converter, and the delay circuits 7*d*/7*e* serve as a delay circuit. The multipliers 7*f*/7*g* and the digital-to-analog converters 7*h*/7*j* as a whole constitute a level changing circuit.

Figure 3:
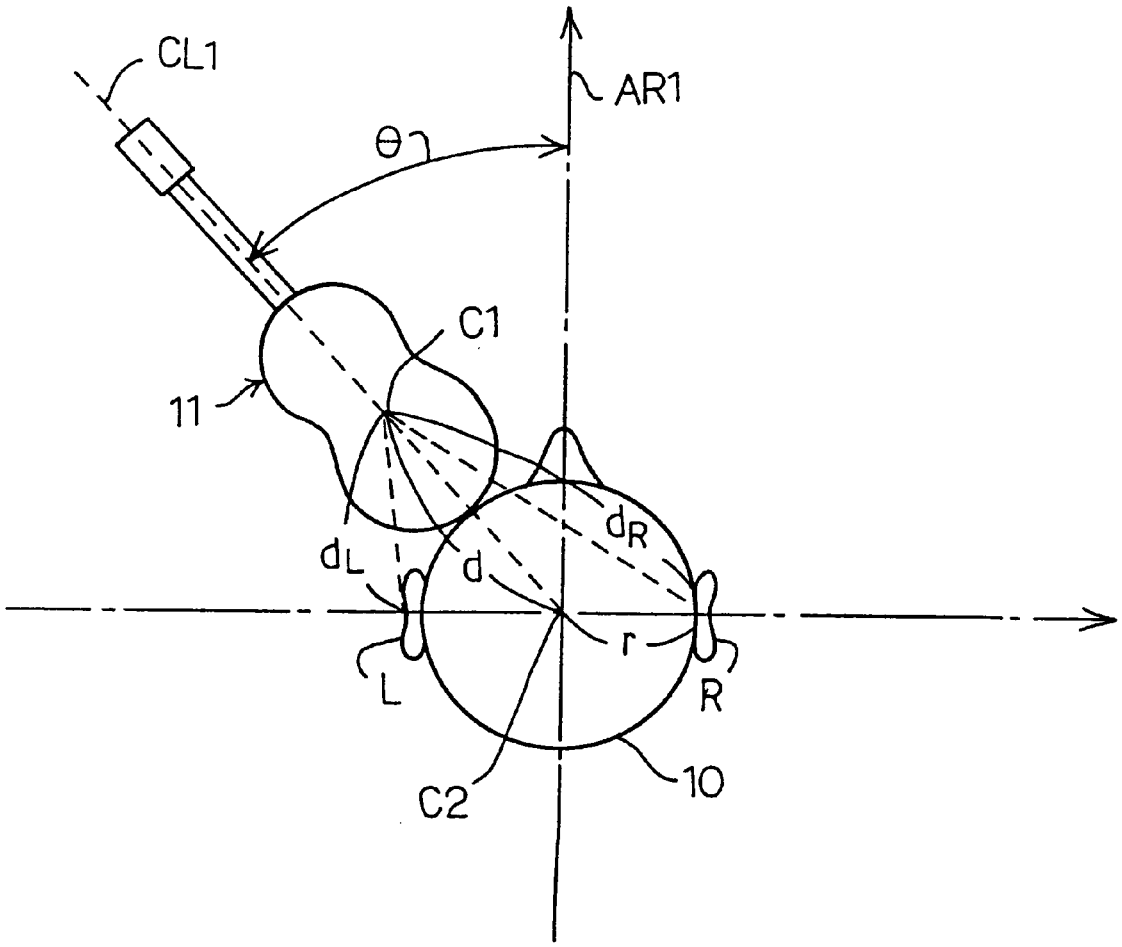
FIG. 3 is a plan view showing a person playing the silent violin.

Description is hereinbelow made on the delay times ΔtL and ΔtR and the predetermined coefficients M1 and M2 for producing stereophonic sounds. Assuming now that a player bows an acoustic violin, the acoustic violin sound is propagated through the air to the ears of the player, and the player feels the sound level and the arriving time different between the right ear and the left ear. FIG. 3 illustrates a person playing the silent violin 11. The person stands, and sets his face in a direction indicated by arrow AR1. The center line CL1 of the silent violin is directed at angle θ with respect to the direction AR1. The center C1 of the silent violin 11 is spaced from the center C2 of the head by distance "d", and the distances between the center C1 and the ears L and R are labeled with dL and dR, respectively. The distances dL and dR are expressed by equations 1 and 2, and the head is assumed to have a radius of curvature r.

$$DL=\sqrt{(r^2+d^2-2dr\times\sin\theta)} \quad \text{equation 1}$$

$$DR=\sqrt{(r^2+d^2+2dr\times\sin\theta)} \quad \text{equation 2}$$

The sound source of an acoustic violin is located around f-letter hole. The distance d and the angle θ are not constant between the players. However, the distance d and the angle θ are averaged to be 254 millimeters and 48 degrees. The delay times ΔtL and ΔtR are given as follows.

$$\Delta tL=dL/v=0.57\ [\text{ms}] \quad \text{equation 3}$$

$$\Delta tR=dR/v=0.97\ [\text{ms}] \quad \text{equation 4}$$

where v is the velocity of sound.

Subsequently, the sound level is analyzed. The acoustic violin sound is propagated from the violin 11 toward the ears L/R, and is diffracted and reflected by the head. For this reason, the difference of sound pressure level is not easily analyzed. The present inventor carried out experiments, and determined the ratio between the sound pressure SPL at the left ear and the sound pressure SPR at the right ear under the condition of d=254 mm and θ=48 degrees. The ratio SPL/SPR was 2.19.

For this reason, the delay circuits 7*d*/7*e* introduce the delay time ΔtL of 0.57 millisecond and the delay time ΔtR of 0.97 millisecond into the signal propagation of the digital signal DS1. The ratio M1/M2 is equal to the ratio SPL/SPR. If the coefficient M1 is determined to be 2.19, the coefficient M2 is 1.0. However, there is individual difference in distance d and the angle θ as described hereinbefore. Using the silent violin, the present inventor carried out an experiment so as to determine the effective range for the delay times ΔtL and ΔtR. The effective range of the delay time ΔtL was between 0.5 millisecond and 1.0 millisecond, and the delay time ΔtR ranged from 1.0 millisecond to 2.0 milliseconds. Even though the ratio ΔtR/ΔtL was increased to about 2.0, the sound source was located as similar to that of the acoustic violin. However, it was recommendable that the delay times ΔtR and ΔtL have difference ranging from 0.5 millisecond to 1.0 millisecond. The present inventor further determined an effective range of the ratio of the sound pressures SPL/SPR through an experiment to be 2.0 to 4.0.

As will be appreciated from the foregoing description, the signal processing circuits 7*d*/7*e* introduce the delay times ΔtL and ΔtR, and the multipliers 7*f*/7*g* differently increase the digital signals DSL1/DSR1 for regulating the ratio of sound pressures SPL/SPR to 2.0 to 4.0. As a result, the player feels the electronic sounds to be stereophonic sounds.

Second Embodiment

Figure 4:
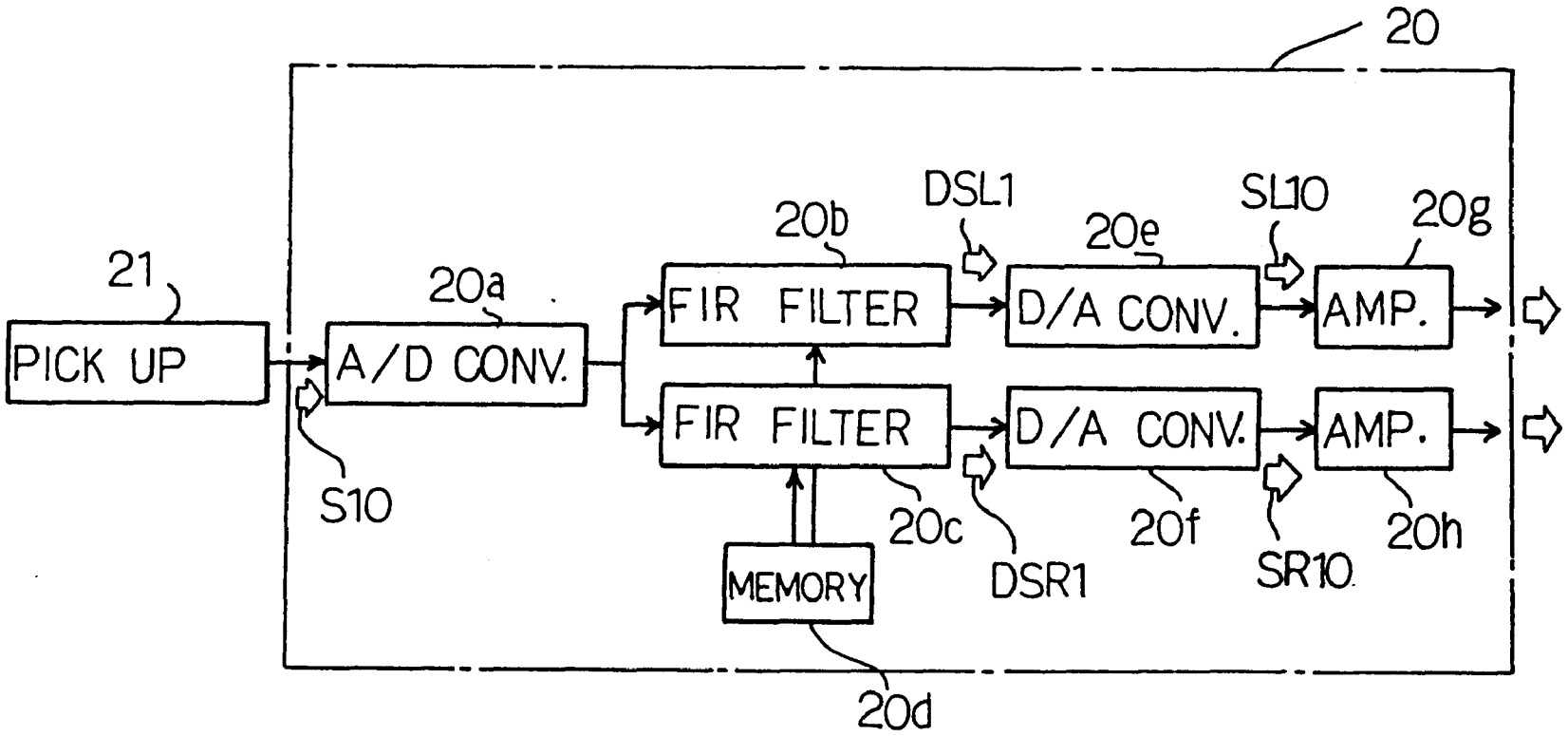
FIG. 4 is a block diagram showing the circuit arrangement of a signal processing circuit incorporated in another silent violin.

FIG. 4 illustrates the circuit configuration of a signal processing circuit 20 incorporated in another silent violin embodying the present invention. The signal processing circuit 20 is connected to a pickup 21, and includes an analog-to-digital converter 20*a,* two FIR (Finite-duration Impulse-Response) filter circuits 20*b*/20*c* connected to the analog-to-digital converter 20*a,* a memory 20*d* connected to the FIR filters 20*b*/20*c,* two digital-to-analog converters

20*e*/20*f* connected to the FIR filters 20*b*/20*c* and two amplifiers 20*g*/20*h*. The memory 20*d* stores filter factors, and supplies the filter factors to the FIR filters 20*b*/20*c*. The analog-to-digital converter 20*a*, the digital-to-analog converters 20*e*/20*f* and the amplifiers 20*g*/20*h* are similar to the analog-to-digital converter 7*c*, the digital-to-analog converters 7*h*/7*j* and the amplifiers 7*m*/7*n*, respectively, and description is focused on the FIR filters 20*b*/20*c* and the memory 20*d* for the sake of simplicity.

The pickup 21 is embedded into the bridge, and converts the vibrations to an analog signal S10 representative of the exciting force exerting on the strings at the contact points. An impulse response represents how the ears catches an influence of the exciting force at the contact points to the strings, and the impulse response from the sound source to the ears is previously determined through experiments. In order to determine the impulse response, impulse-like force is applied to strings of an acoustic violin under the conditions where the strings are held in contact with a felt sheet. The strings do not vibrate. The sound chamber of the acoustic violin produces a plurality of pulses, and the analyst measures the timing of each occurrence and the pulse height at the positions equivalent to the ears of a virtual player who plays the acoustic violin. If the silent violin has the bridge equivalent to that of an acoustic violin, the impulse-like force is, by way of example, applied to the acoustic violin by striking an upper surface of the sound chamber of the acoustic violin, because it is not necessary for the analyst to take the response characteristics of the bridge of the acoustic violin into account. On the other hand, if the silent violin does not have a bridge, the impulse-like force is applied to the acoustic violin by striking an upper surface of the bridge, because the response characteristics of the bridge has an influence on the impulse response of the acoustic violin. Thus, the structure of silent violin makes the propagation path from the vibration source to the ears different, and the analyst changes the propagation path to be simulated for the impulse response. The vibrations of an acoustic violin may be analyzed from the aspect that how the vibrations reach the ears of a player so as to determines the impulse response. In this way, the space characteristics, the reflecting characteristics on the ears and the resonant characteristics are taken into account for the impulse response, and the FIR filters 20*b*/20*c* reproduce the impulse response.

Figure 5A:
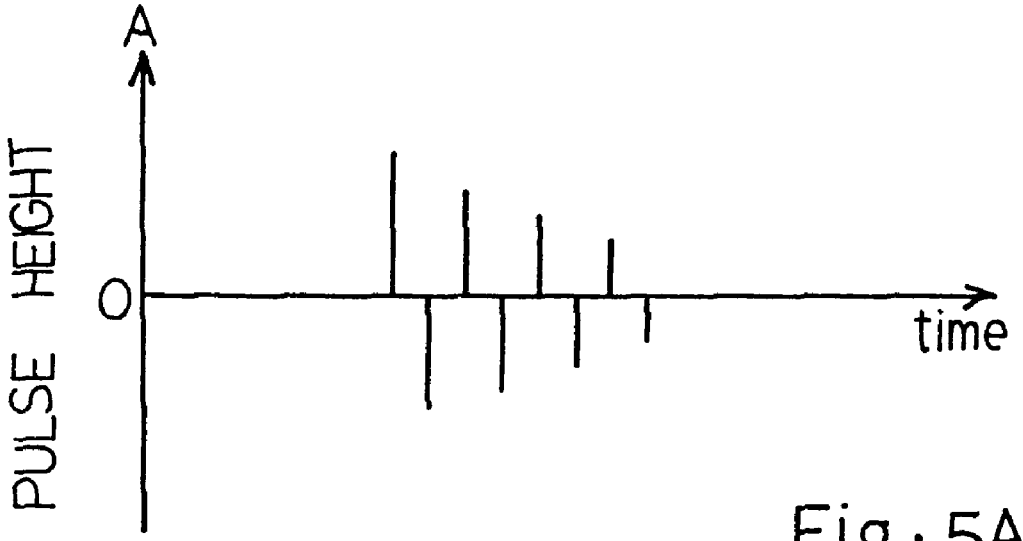
FIGS. 5A and 5B are graphs showing an impulse response at the left ear and the right ear of a player.
Figure 5B:
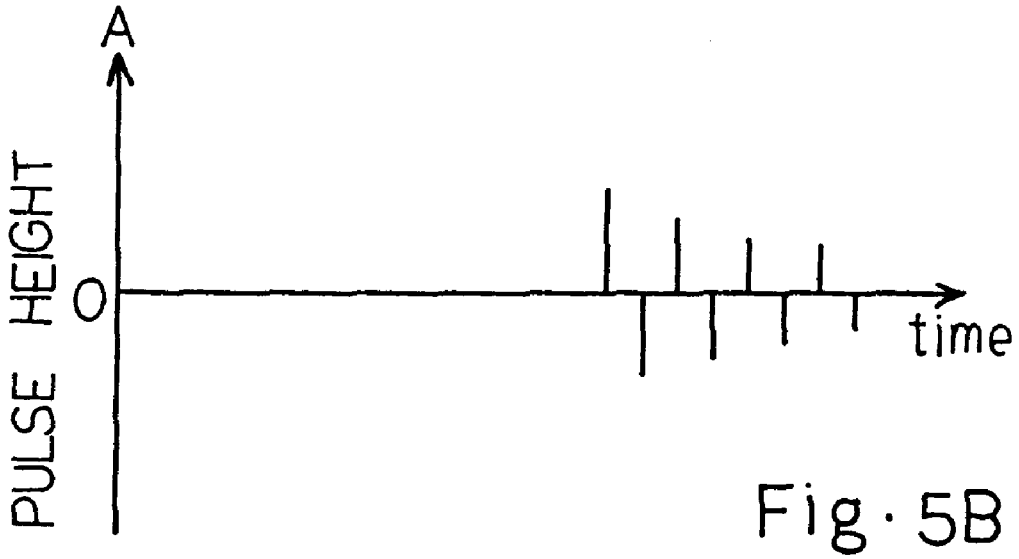

FIGS. 5A and 5B illustrate the impulse response determined as described hereinbefore. Beats was intermittently applied to an acoustic violin, and the beats reach the left ear as shown in FIG. 5A and the right ear as shown in FIG. 5B.

The transfer functions for the impulse response are stored in the memory 20*d*, and are initially set to the FIR filters 20*b*/20*c* as the filter functions. For this reason, the FIR filters 20*b*/20*c* outputs digital signals DSL1/DSR1 different in magnitude and the delayed from each other. The digital signals DSL1/DSR1 are converted to analog signals SL10/SR10, and stereophonic sounds are produced from the analog signals SL10/SR10. The stereophonic sounds reflect the physical characteristics of the acoustic violin such as the resonant characteristics of the sound chamber, and the player feels the sound source of the silent violin to be located around the sound source of the acoustic violin. Moreover, even though the body is solid, the stereophonic sounds reverberate like the acoustic violin sounds, and have a format similar to the acoustic violin sounds.

The resonant characteristics of the sound chamber has sharp peaks and deep valleys as shown in FIGS. 5A and 5B, and the FIR filters 20*b*/20*c* are expected to have the same characteristics. The analog signal S10 contains various frequency components. The FIR filters 20*b*/20*c* emphasize predetermined frequency components, and weaken other predetermined frequency components. In this situation, if the player imparts the vibrato, the frequency components of the analog signal S10 are changed, and the FIR filters 20*b*/20*c* vary the emphasized components and the weakened frequency components. As a result, the not only the pitch of the sound but also the timbre and loudness are varied as if the vibrato is imparted to the acoustic violin sound.

Modifications

Although particular embodiments of the present invention have been shown and described, it will be obvious to those skilled in the art that various changes and modifications may be made without departing from the spirit and scope of the present invention.

An effector may be connected between the multipliers/FIR filters and the digital-to-analog converters.

The pickups may be respectively provided under the strings. In this instance, the signal processing circuit 7*b* or 20 is connected to each of the pickups. The analog signals SL1 from the signal processing circuits are mixed with one another, and the other analog signals SR1 are also mixed with one another. In this instance, if the parameters, i.e., coefficients/delay times or the filter factors are differently regulated, the player feels the silent violin has sound sources corresponding to the strings.

If the parameters are changeable, the player can arbitrarily assign sounds sources to any points on the body.

In the first and second embodiments, the delay and the difference of the magnitude are analyzed on the assumption that the player hears the sounds through a headphone. A silent violin may produce the sounds from left and right speakers. In this instance, the parameters are determined through an analysis for a propagation path from a sound source of an acoustic violin and the left and right speakers.

Finally, the present invention is applicable to any kind of stringed instrument. If various sets of filter factors are previously stored in the memory, the player selects one of the sets, and enjoys a performance under the most appropriate parameters inherent in the selected stringed instrument.

What is claimed is:

1. A silent stringed musical instrument comprising a body structure held by a player in an offset manner from a virtual center plane perpendicular to a virtual line between a first sound producing means and a second sound producing means, at least one string stretched over said body structure and caused to vibrate by said player, and an electric system for converting the vibrations of said at least one string to sounds and including a vibration-to-electric signal converter producing an electric signal from said vibrations, a delay circuit introducing a first delay time and a second delay time into propagation of said electric signal by 0.5 millisecond to 1.0 millisecond and 1.0 millisecond to 2.0 milliseconds for producing a first delayed signal and a second delayed signal, and a level changing circuit regulating a ratio of the magnitude of said second delayed signal to the magnitude of said first delayed signal to 2.0 to 4.0 for locating a sound source of said sounds around a sound source of acoustic sounds produced from an acoustic stringed musical instrument.

2. The silent stringed musical instrument as set forth in claim 1, in which said vibration-to-electric signal converter includes at least one pickup provided for said at least one string for producing said electric signal.

3. The silent stringed musical instrument as set forth in claim 2, in which said delay circuit includes an analog-to-digital converter connected to said at least one pickup for producing a series of digital codes from said electric signal, and delay circuits connected in parallel to said analog-to-digital converter and introducing said first delay time and said second delay time into propagation of said series of digital codes for producing said first delayed signal and said second delayed signal.

4. The silent stringed musical instrument as set forth in claim 3, in which said level changing circuit includes multipliers respectively connected to said delay circuits and multiplying the value of said first delayed signal and the value of said second delayed signal by a first multiplier factor and a second multiplier factor different from each other for producing a first product signal and a second product signal, and digital-to-analog converters respectively connected to said multipliers for producing a first audio signal and a second audio signal from said first product signal and said second product signal, respectively.

5. The silent stringed musical instrument as set forth in claim 4, further comprising amplifiers connected to said digital-to-analog converters for changing a magnitude of the first audio signal and a magnitude of said second audio signal, and a sound system supplied with said first and second audio signals for producing said sounds.

6. A silent stringed musical instrument comprising a body structure held by a player in an offset manner from a virtual center plane perpendicular to a virtual line between a first sound producing means and a second sound producing means, at least one string stretched over said body structure and caused to vibrate by said player, and an electric system for converting the vibrations of said at least one string to sounds and including a vibration-to-electric signal converter producing an electric signal from said vibrations, a memory means for storing an impulse response characteristics of a propagation from a sound source of acoustic sounds in an acoustic stringed instrument to a first sound producing means and a second sound producing means, and an output means imparting said impulse response characteristics to said electric signal for locating a sound source of said silent stringed musical instrument around said sound source of said acoustic sounds with respect to said first and second sound producing means.

7. The silent stringed musical instrument as set forth in claim 6, in which said output means includes finite-duration impulse-response filters.

8. The silent stringed musical instrument as set forth in claim 7, said output means further includes an analog-to-digital converter connected between said vibration-to-electric signal converter and said finite-duration impulse-response filters and digital-to-analog converters connected to said finite-duration impulse-response filters.

* * * * *